United States Patent [19]

Dove

[11] 4,358,900

[45] Nov. 16, 1982

[54] APPARATUS TO SUPPLY STEAM INCLUDING STEAM EVACUATION

[76] Inventor: Norman F. Dove, 3187 Hoskins Rd., North Vancouver, British Columbia, Canada, VTJ 3B5

[21] Appl. No.: 190,472

[22] Filed: Sep. 24, 1980

[51] Int. Cl.[3] ..... F26B 13/00; F26B 21/06

[52] U.S. Cl. ..... 34/54; 34/155; 34/160; 162/207

[58] Field of Search ..... 34/54, 155, 156, 160, 34/114, 122; 162/207, 359, 290

[56] References Cited

U.S. PATENT DOCUMENTS

| | | | |
|---|---|---|---|
| 2,919,495 | 1/1960 | Underhay et al. | 34/160 |
| 3,089,252 | 5/1963 | Daane et al. | 34/114 |
| 3,777,781 | 12/1973 | Dove | 34/160 |
| 4,069,595 | 1/1978 | Ahlbert et al. | 34/156 |
| 4,096,643 | 6/1978 | Futcher | 34/122 |
| 4,163,688 | 8/1979 | Kankaanpaa | 162/290 |

*Primary Examiner*—Larry I. Schwartz

*Attorney, Agent, or Firm*—Richard H. Zaitlen

[57] ABSTRACT

Apparatus to supply steam to a paper sheet moving beneath it. The apparatus has a leading edge and a trailing edge relative to sheet direction. It has a header and there is a supply of steam to the header. A chamber is positioned adjacent to the header. Steam can be transferred from the header to the chamber. A heating zone is defined beneath the chamber to be generally adjacent to the paper sheet when the apparatus is in use. Outlets in the chamber permit steam to pass from the chamber to the heating zone. Exhaust manifolds positioned adjacent to the leading edge and the trailing edge of the apparatus permit excess steam and vapor to be drawn away from the heating zone.

11 Claims, 7 Drawing Figures

APPARATUS TO SUPPLY STEAM INCLUDING STEAM EVACUATION

FIELD OF THE INVENTION

This invention relates to an apparatus for supplying steam to a paper sheet moving beneath it. The apparatus has a leading edge and a trailing edge relative to sheet direction.

DESCRIPTION OF THE PRIOR ART

The benefits of applying steam to a paper sheet either at the fourdrinier or in the press section of a paper making machine are well known. The application of steam heats the water contained in the paper sheet thereby lowering the viscosity and surface tension of the water and thus enhancing the water drainage rate.

To penetrate the paper sheet with steam a driving force is required. Ideally this is made available by a vacuum device located under the sheet, which provides a pressure differential across the sheet. The pressure differential is used to pull steam into the sheet thus providing a heat exchange as the steam comes into intimate contact with the water contained by the sheet. When the steam condenses the latent heat is transferred into sensible heat and the water is heated, which lowers its viscosity and surface tension.

However, when the vacuum is insufficient or where there is no vacuum available, for example where the sheet runs between presses, the necessary driving force has to be made available from the top of the sheet. This is accomplished in the prior art by forcing high velocity steam downwardly onto the sheet.

When forcing high velocity steam downward in this manner it is not possible to absorb all of the steam into the sheet. The steam that is not absorbed makes its way into the machine room of the paper mill. Thus, although the downward forcing of steam onto a paper sheet can easily be shown to provide advantages, there are disadvantages in that large amounts of steam spill from the apparatus. This is wasteful of steam and provides an undesirable environment in the machine room.

It is further desirable that the steam supplied to the sheet at any stage of the paper making process be free of condensate. Condensate impinging on the sheet can damage the structure of the sheet and also discolour it.

SUMMARY OF THE INVENTION

The present invention provides an apparatus able to project high velocity steam onto a paper sheet moving beneath it. A particular feature of the invention is that there is a steam and air evacuation system at the leading and trailing edges of the apparatus that evacuates unwanted steam without spilling it into the machine room. As further features the apparatus is able to project steam at the sheet that is free of condensate and provides means of controlling the steam output in the cross machine direction thus enabling cross machine moisture profile control. Profiling is a term of art for varying the application of steam to a paper sheet in response to the sensed moisture content in different parts of the sheet. Where the moisture content is high more steam is applied to enhance the drainage rates at those parts of the sheet.

Thus, the present invention is an apparatus to supply steam to a paper sheet moving beneath it, the apparatus having a leading edge and a trailing edge relative to sheet direction and comprising; a header; means to supply steam to the header, a chamber adjacent to the header; means to permit the controlled transfer of steam from the header to the chamber; a heating zone defined beneath the chamber to be generally adjacent to the paper sheet when the apparatus is in use; outlets in the chamber to permit steam to pass from the chamber to the heating zone; exhaust manifolds positioned adjacent to the leading edge and the trailing edge of the apparatus whereby excess steam may be drawn up from the heating zone.

To permit profiling the chamber is subdivided into a plurality of compartments in the cross machine direction in a preferred embodiment. There are then means to control the steam supply from the header to each of the plurality of compartments.

Furthermore, the apparatus may be subdivided into a plurality of compartments in the machine direction with, again, means to control the steam supply from the header to each compartment.

BRIEF DESCRIPTION OF THE DRAWINGS

Embodiments of the invention are illustrated in the accompanying drawings in which.

DESCRIPTION OF THE PREFERRED EMBODIMENTS

Figure 1:
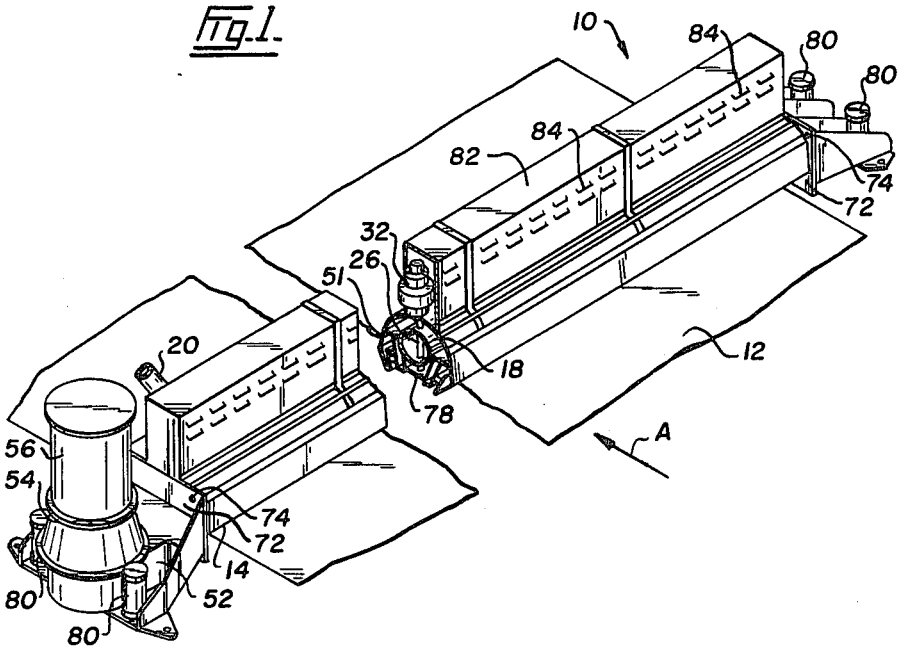
FIG. 1 is a general view of an apparatus according to the present invention.

FIG. 1 illustrates an apparatus 10 to apply steam to paper sheet 12 moving beneath it. The apparatus has a leading edge 14 and a trailing edge 16 relative to sheet direction as indicated by arrow A in FIGS. 1, 2 and 3.

Figure 4:
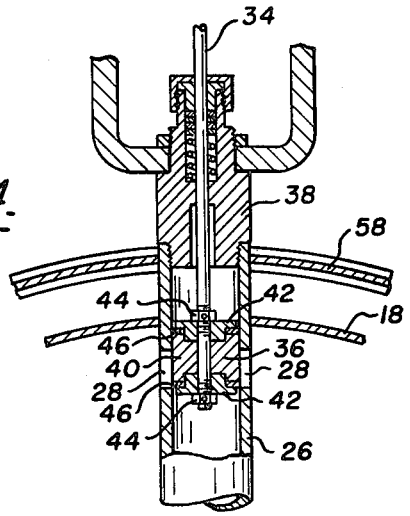
FIG. 4 is a detail of a valve useful in the machines of FIGS. 1 to 3.
Figure 2:
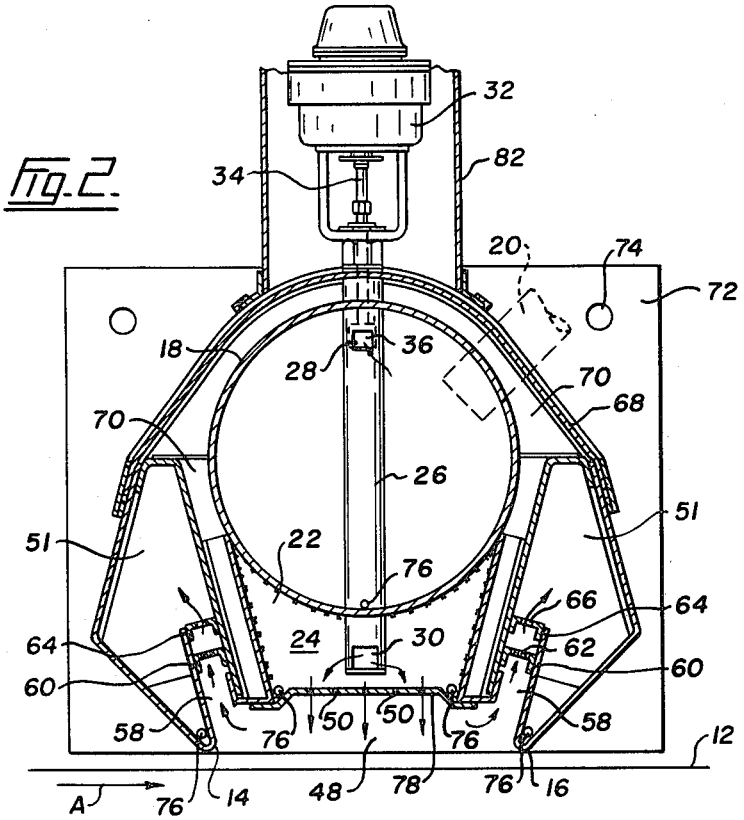
FIG. 2 is a cross section of an apparatus according to a preferred embodiment of the present invention.

Referring to FIGS. 1 and 2 the apparatus comprises a header 18. There are means to supply steam to the header indicated generally as a pipe 20. There is a chamber 22 adjacent the header 18 and means to control the transfer of steam from the header 18 to the chamber 22. In the preferred embodiment illustrated in FIG. 2 chamber 22 is divided into compartments in the cross machine direction by a plurality of baffles 24 welded into position. In these circumstances, the means to permit the controlled transfer of steam comprises a pipe 26 connecting each compartment to the header 18. There is an inlet 28 for each pipe 26 in the header 18 and an outlet 30 for each pipe 26 in each compartment. A pressure responsive valve actuator 32, which is an available commercial item, is attached to a supply of compressed air, available in any mill. The actuator 32 positions a connecting rod 34 extending downwardly with a piston 36 attached to the connecting rod 34 and alignable with each inlet 28. As illustrated more particularly in FIG. 4 there is a bonnet assembly 38 located in the upper end of the pipe 26 and the piston 36 comprises a solid body 40 located by end caps 42 which, in turn, are located by nuts 44 on a threaded end of the connecting rod 34. There are low friction guides 46, for example of PTFE, inserted between the end caps 42 and the body 40 to facilitate sliding of the piston 40 within the pipe 26.

Figure 5:
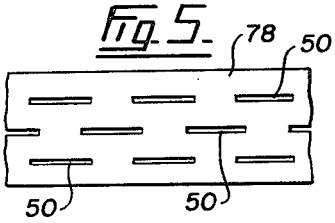
FIGS. 5 to 5B illustrate details of the apparatus of FIGS. 1 to 3.
Figure 5A:
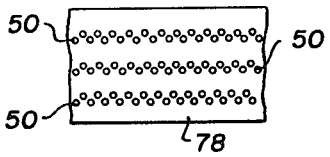
Figure 5B:
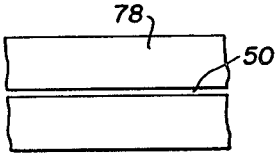

There is a heating zone 48 defined beneath the chamber generally adjacent the paper sheet 12 when the apparatus 10 is in use. Outlets 50 in the compartment of chamber 22 permit steam to pass from the compartments of chamber 22 to the heating zone 48, where the steam contacts the paper sheet 12. The arrangement of the outlets 50 may be any that permits steam to be directed onto the sheet 12. Some general arrangements are shown in FIGS. 5 to 5B. FIG. 5 illustrates outlets 50 formed as elongated slots, each slot staggered in relation to the slots in the adjacent row. FIG. 5A illustrates the arrangement of the outlets 50 as holes formed at isometric centers in three lines. FIG. 5B illustrates a single slot extending the length of the apparatus.

Figure 3:
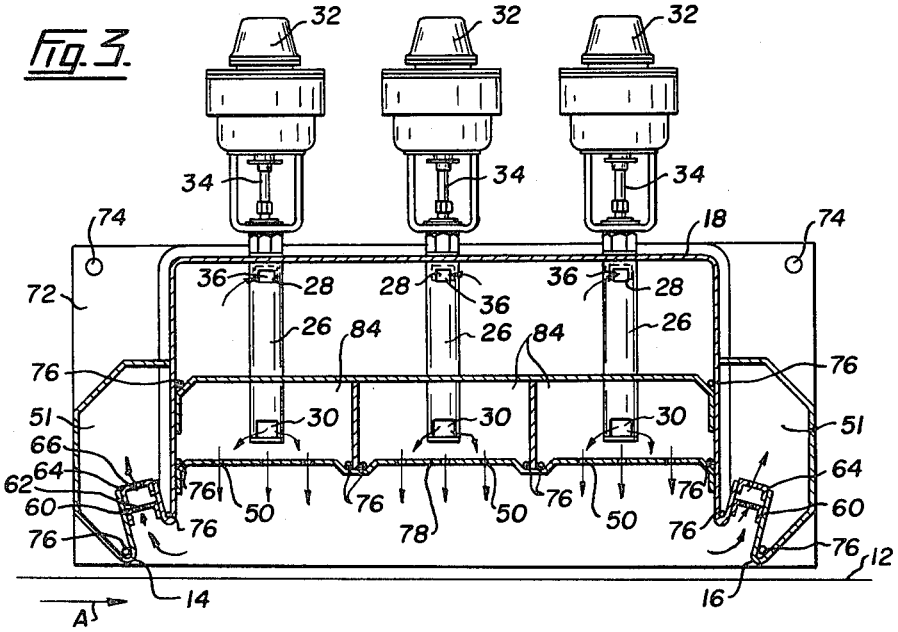
FIG. 3 is a cross section of a further embodiment of the invention.

There are exhaust manifolds 51 positioned adjacent to both the leading edge 14 and the trailing edge 16 of the apparatus 10 so that excess steam vapour may be drawn up from the heating zone as shown by the arrows in FIGS. 2 and 3.

As illustrated in FIG. 1 the manifolds 51 terminate at one end in ducting 52 that opens into an exhaust system comprising a mist eliminator 54 and centaxial exhaust blower 56, both of known construction and thus not illustrated in detail here.

As shown in FIG. 2 steam vapour enters the manifolds 51 through the inlets 58 provided with a first plate 60 having openings 62 through which the steam vapour passes to a second plate 64 having openings 66. The openings 66 increase in area in a direction away from the centaxial exhaust blower 56. Uniform evacuation of steam vapour along the length of the apparatus is accomplished by first creating a pressure drop across openings 62 which is greater than 4 times the pressure difference across the manifold length and by reducing the pressure difference at openings 66 to compensate for losses through the manifold. It should also be noted that the particular section of the manifold 51 illustrated in FIG. 2 is such that it provides a uniform flow across the relatively narrow and long inlets 58 to manifolds 51.

As illustrated particularly in FIG. 2 the apparatus 10 is desirably provided with shrouding 68 that may be packed with insulating material 70, for example glass fibre. The apparatus has end plates 72 with holes 74 to provide a means of lifting the apparatus.

Drains 76 are provided at the various low points of the apparatus 10 so that condensate may be trapped at those low points then fed away through the condensate drains 76. In this regard the base 78 of the chambers 24 are shaped to provide low points at their edges.

Although not forming a part of the invention the apparatus 10 is provided with air cylinders 80 so that it may be lifted quickly from the sheet 12. These cylinders, for example those available under the trade mark Martonair, are well known in the paper making art. It is also desirable that the actuators 32 be enclosed within canopies 82 preferably provided with louvres 84 for heat dissipation.

In use steam enters the illustrated apparatus through inlet pipe 20 into the header 18. From the header 18 the steam enters an inlet 28 of the pipe 26 and passes to the chamber 22 through outlets 30. From the outlets 30 the steam passes through outlets 50 down onto the sheet 12. Condensate is trapped at those low points then fed away through the condensate drains 76.

Where, as in the preferred embodiment, it is desired to provide an apparatus that can vary the steam supply across the apparatus, that is in the cross machine direction, the actuators 32 provide means to vary the steam supply to an individual compartment of chamber 22 by raising or lowering the pistons 36 which changes the open area of the inlet 28. These pistons 36 can, in addition to the air actuation illustrated in the drawings, be hand operated. The actuators 32 are controlled remotely either by an operator who manipulates a manual loader or by an on-machine computer. Where an on-machine computer is used means are required to measure the moisture content of the sheet at the reel. Such means are commonly used and commercially available. The electronic signal generated, which corresponds to the moisture level, is converted to a pneumatic signal for the actuator. A higher sensed moisture level results in a higher steam flow from the outlet 30 as the inlet 28 controlled by the piston 36 is opened.

The steam is forced downwardly from outlets 50 through the heating zone 48 into the sheet 12. The excess steam vapour is exhausted by the exhaust blower 56 through the manifolds 51 and through mist eliminator 54.

In the modified apparatus illustrated in FIG. 3 operation is as illustrated above but there is the additional feature that the apparatus is divided into compartments 84 in the machine direction. However, the control of the supply of steam to each of the compartments is as described in FIG. 2.

I claim:

1. Apparatus to supply steam to a paper sheet moving beneath it, the apparatus having a leading edge and a trailing edge relative to sheet direction and comprising:

a header;

means to supply steam to the header;

a chamber adjacent to the header;

means dividing the chamber into a plurality of compartments in the cross machine direction;

a pipe connecting each compartment to the header to supply steam from the header to each of the plurality of compartments, an inlet for each pipe in the header, an outlet for each pipe in each compartment, a valve control associated with each pipe and a piston extending from the valve control to the pipe inlet whereby control of the steam supply from the header to the individual compartments of the steam chamber can be achieved;

a heating zone defined beneath the chamber to be generally adjacent to the paper sheet when the apparatus is in use;

outlets in the chamber to permit steam to pass from the chamber to the heating zone;

exhaust manifolds positioned adjacent to and substantially coextensive with the leading edge and the trailing edge of the apparatus whereby excess steam vapour may be drawn away from the heating zone.

2. Apparatus as claimed in claim 1, in which the valve control is a pressure responsive actuator controlled by air pressure.

3. Apparatus as claimed in claim 1 in which the valve control is manually operable.

4. Apparatus as claimed in claim 1 in which the exhaust manifolds converge to a mist eliminator; and including means to force steam through the exhaust manifolds to the mist eliminator.

5. Apparatus as claimed in claim 1 including pipes positioned at relative low spots in the apparatus to act as condensate drains.

6. Apparatus as claimed in claim 1 in which the steam chamber is divided into a plurality of compartments in the machine direction;

means to control the supply of steam from the header to each compartment.

7. Apparatus as claimed in claim 6 in which the means to control the steam supply comprises a pipe connecting each compartment of the steam chamber to the header;

an inlet for each pipe in the header;

an outlet for each pipe in each compartment;

an inlet for each pipe in the header;

an outlet for each pipe in each compartment;

a valve control associated with each pipe;

a piston extending from the valve control to the pipe inlet in the header whereby control of the steam supply from the header to the individual compartments of the steam chamber can be achieved.

8. Apparatus as claimed in claim 7, in which the valve control is a pressure-responsive actuator controlled by air pressure.

9. Apparatus as claimed in claim 7 in which the valve control is manually operable.

10. Apparatus as claimed in claim 4, in which the exhaust manifolds are provided with a plurality of plates through which the steam must pass before entering the manifold, a first plate having a plurality of openings adjacent the heating zone and a second plate, having a plurality of openings, adjacent the interior of the manifold, the openings in said second plate increasing in size with distance from the means to pull air through the exhaust manifolds.

11. Apparatus as claimed in claim 4, in which the means to pull steam through the exhaust manifolds is a centaxial exhaust blower.

* * * * *